United States Patent [19]

Hovanic et al.

[11] Patent Number: 4,882,456

[45] Date of Patent: Nov. 21, 1989

[54] LOCKING DEVICE FOR ELECTRICAL SWITCH OR CIRCUIT BREAKER HANDLE

[75] Inventors: Steven F. Hovanic, Barboursville; David W. Bryce, Charlottesville, both of Va.

[73] Assignee: Cooper Industries, Inc., Houston, Tex.

[21] Appl. No.: 795,020

[22] Filed: Nov. 4, 1985

[51] Int. Cl.[4] ..... H01H 9/28

[52] U.S. Cl. ..... 200/43.15; 200/43.19

[58] Field of Search ..... 200/43.15, 43.14, 43.19, 200/43.21

[56] References Cited

U.S. PATENT DOCUMENTS 2,169,860 8/1939 Van Hoorn ..... 200/43.15

3,055,995 9/1962 Snow ..... 200/43.15

3,678,228 7/1972 Adamson ..... 200/43.15

*Primary Examiner*—Renee S. Luebke

*Attorney, Agent, or Firm*—Nelson A. Blish; Eddie E. Scott; Alan R. Thiele

[57] ABSTRACT

A locking device for a circuit breaker or electrical switch handle includes a support member having an opening conforming to the shape of the switch handle housing or escutcheon and a pair of spaced apart upstanding flanges projecting from the opening. A lock pin extends through openings in the respective flanges and through an aperture in the switch handle to prevent movement of the handle relative to the support member. An arm connected to one end of the pin may be secured to one end of the flanges by the shackle of a padlock or the like to prevent removal of the pin from the support member and from the switch handle.

9 Claims, 3 Drawing Sheets

LOCKING DEVICE FOR ELECTRICAL SWITCH OR CIRCUIT BREAKER HANDLE

BACKGROUND OF THE INVENTION

1. Field of the Invention

The present invention pertains to a locking device for attachment to a switch or circuit breaker for locking a switch handle in a predetermined position.

2. Background

There are many applications for a locking mechanism which may be readily attached to an electrical circuit breaker or switch panel for locking one or more switches in a predetermined position of the switch handle. Some of the desiderata for such a device include the provision of a device which does not require modification of the switch panel such as by drilling or tapping for receipt of fasteners or removal of the panel face for attachment of the device.

A preferred switch locking device should also be relatively compact so as to not interfere with adjacent switches on a multi-switch panel and be relatively flat against the face of the panel to permit closure of a cabinet or enclosure box door adjacent to the panel face. Still further considerations include the provision of a device which will not substantially prevent viewing of the switch position and other identifying indicia on the face of the switch panel itself and the provision of a device which will allow a circuit breaker handle to move from an "on" position to a "tripped" position but not to a manually actuated "off" position.

Some examples of prior art switch handle locking devices which do not meet all of the desiderata indicated above, are described in U.S. Pat. Nos. 2,169,860 to F. G. Von Hoorn; 2,978,613 to E. Hein; 3,376,400 to T. N. Batt, et al; 3,595,040 to R. D. Curt; 4,006,324 to Leasher, et al; 4,260,861 to DiMarco; 4,300,030 to DiMarco, et al; and 4,467,152 to Gordy. The handle locking devices disclosed in the above identified patents require special modification of the switch panel or enclosure, are characterized by relatively complex structures which are designed in such a way that they must be retained on the switch panel itself and are not self-retaining as a result of engagement with a switch handle, or are relatively bulky and require more space than is commonly provided in many electrical switch installations. However, the present invention overcomes several disadvantages of prior art devices as will be appreciated by those skilled in the art upon reading the following summary and detailed description.

SUMMARY OF THE INVENTION

The present invention pertains to a locking device for an electrical switch handle or circuit breaker handle whereby the switch handle is secured in ether the switch "on" or "off" position and wherein the device does not require any substantial modification of the switch handle, the switch panel structure or the provision of means for retaining the switch locking device on the panel other than its engagement with the switch handle itself.

In accordance with one aspect of the invention, there is provided a switch locking device including a support member which is adapted to fit over and in surrounding relationship to a portion of a switch handle housing which projects from an adjacent surface such as the surface of a switch panel housing or other structure. In particular, the raised surface may form part of a switch handle support or escutcheon which is operable to locate the locking device support member. The support member preferably includes a pair of spaced apart upstanding flanges which are adapted to support a handle locking pin which projects through an aperture or similar pin receiving means in the switch handle. At least one of the flanges is provided with an aperture for receiving an arm attached to the locking pin whereby the pin may be secured in the handle locked position by a padlock having a shackle which projects through the arm and an aperture in the flange to secure the arm to the flange to thereby prevent removal of the locking pin.

The support member may take various configurations such as including the provision of spaced apart flanges which are formed as a continuous metal or plastic band which includes integral opposed end walls, or the flanges may be interconnected by spaced apart support pins which are engageable with the switch handle support or escutcheon.

In accordance with yet another aspect of the present invention a switch locking device is provided which includes a support member particularly adapted for use of the locking device with automatic circuit breaker actuating handles wherein the circuit breaker actuating handle is operable when connected to the device to move from an "on" position to a "tripped" position but is prevented from being manually moved between the "on" and "off" positions of the circuit breaker handle. In this way indication of the automatic "tripping" of the circuit breaker is not prevented by the locking device but manual actuation of the circuit breaker handle is prevented in moving the handle from the "on" to "off" positions.

In accordance with still a further aspect of the present invention, there is provided a locking device for an electrical switch handle which basically comprises only two parts which may be connected to the handle in operative locking positions without modifying the switch handle or any of the structure adjacent to the handle and while providing virtually unrestricted visual access to the handle and to the handle housing or panel surface directly adjacent the handle itself.

The abovenoted advantages and features of the invention as well as additional superior aspects thereof will be further appreciated by those skilled in the art upon reading the following detailed description.

DESCRIPTION OF THE PREFERRED EMBODIMENT

Figure 1:
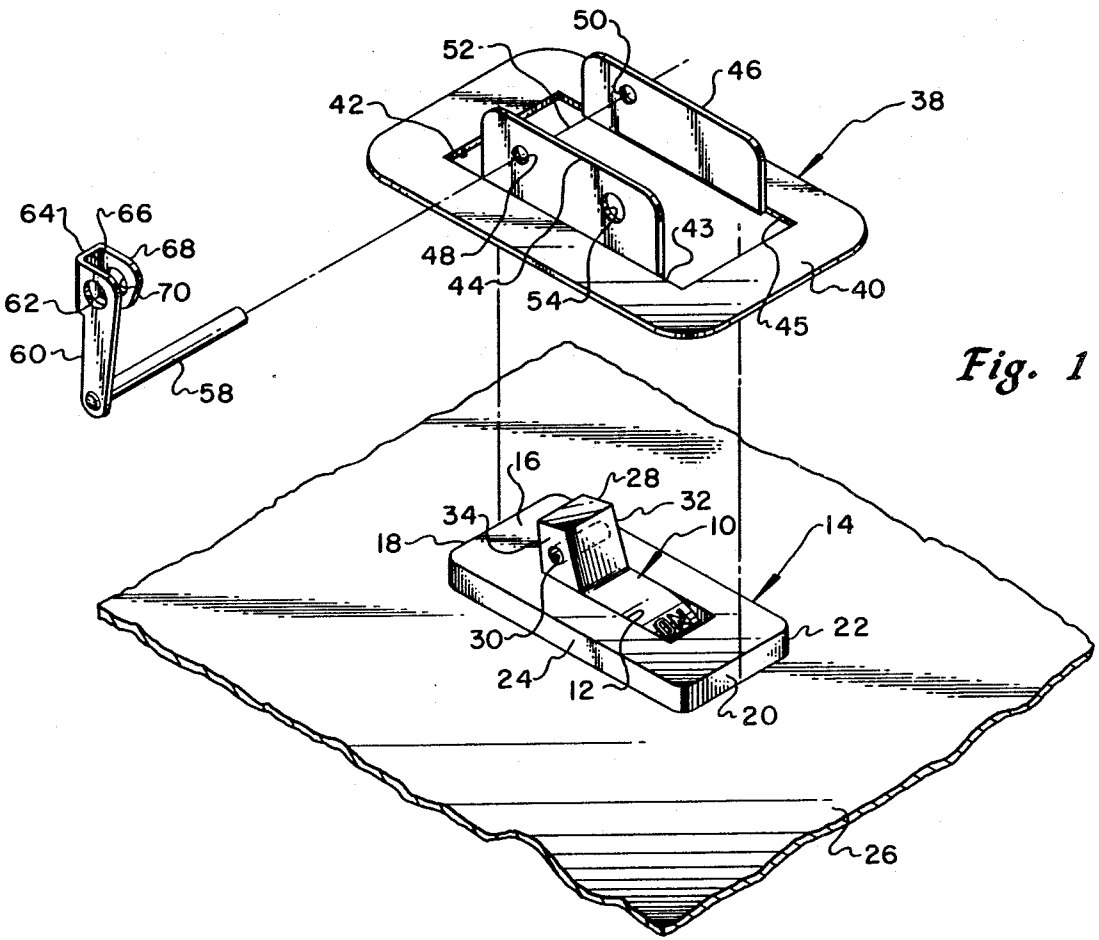
FIG. 1 is a perspective view of the handle locking device of the present invention disassembled and shown in position to be assembled in locking engagement with an electrical switch handle.

In the description which follows like parts are marked throughout the specification and drawing with the same reference numerals, respectively. The drawing figures are not necessarily to scale and certain features of the invention may be shown exaggerated in scale in the interest of clarity.

Referring to FIG. 1, the switch handle locking device of the present invention is shown disassembled from an electrical switch or circuit breaker actuating member, generally designated by the numeral 10. The actuating member 10 projects through a generally rectangular opening 12 formed in a switch or circuit breaker handle support housing 14. The housing 14 includes a generally rectangular portion 16 defining a rather planar surface delimited by opposed end walls 18 and 20 and opposed side walls 22 and 24. The portion of the housing 14 defined by the end walls 18 and 20, the side walls 22 and 24 and the planar surface 16 comprises an escutcheon or raised portion which projects from the surface of a switch housing or panel wall, generally designated by the numeral 26.

The actuating member 10 includes a handle portion 28 which projects through the opening 12 and away from the switch housing or escutcheon 14 and is provided with an aperture 30 which extends through the handle portion 28 between opposed side surfaces 32 and 34. The actuating member 10 is adapted to be thrown into a selected one of at least two positions such as "on" or "off" positions, for example, to connect or disconnect an electrical circuit. In many applications of electrical circuit breakers or switches, it is desirable to lock the switch operating handle or actuating member in an "on" or "off" position for various reasons as described in the prior art patents referenced hereinabove. The handle portion 28 may also be operable to move to an intermediate or "tripped" position between the "on" and "off" positions. As previously mentioned, it is desirable to provide means for locking the handle in a selected position which is mechanically uncomplicated, does not require modification of the switch housing or support panel and permits relatively unobstructed viewing of the switch handle and the surrounding support structure therefor so that any identifying indicia with respect to the function of the switch may be viewed when the switch handle locking device is in its operative position.

Figure 2:
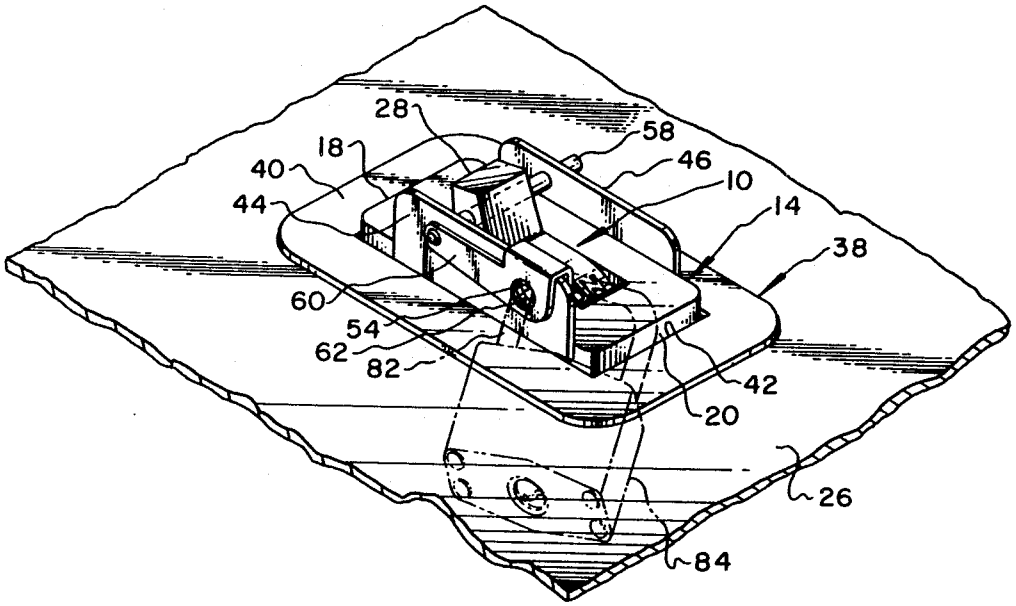
FIG. 2 is a perspective view of the switch handle locking device in the engaged and locked position of the handle.

Referring further to FIG. 1, the switch handle locking device includes a support member, generally designated by the numeral 38 which includes a generally rectangular planar plate portion 40 having a rectangular opening 42 formed therein and conforming substantially to the shape of the housing portion 14. The dimensions of the opening 42 are slightly larger than the peripheral or external dimensions of the housing portion 14 so that the plate member 38 may fit snugly around the housing portion 14 and in contact with the panel surface 26, as illustrated in FIG. 2. The support member 38 also includes a pair of spaced apart integral flanges 44 and 46 extending generally normal to the planar portion 40 along opposed longitudinal sides 43 and 45 of the opening 42. The flanges 44 and 46 are provided with openings 48 and 50, respectively, which are aligned with each other along an axis 52. The flange 44 includes a second opening or aperture 54 formed therein and spaced from the opening 48, the purpose of which will be explained in further detail herein.

The switch handle locking device further includes a switch handle engaging or locking member comprising an elongated generally cylindrical pin 58 of sufficient length to extend between and through the openings 48 and 50 and be supported by the flanges 44 and 46. The pin 58 is attached at one end to an arm 60 having an opening 62 formed therein which is spaced from the pin 58 the same distance as the spacing of the openings 48 and 54. The arm 60 preferably includes a generally u-shaped distal portion 64 forming a channel 66 defined by a tab 68 also having an opening 70 aligned with the opening 62. The u-shaped or channel shaped portion 64 of the arm 60 gives additional strength to the arm to minimize the consequences of deliberate damage or vandalism inflicted on the arm in an attempt to break the locking device off of the actuating member 10 and permits the use of padlocks with relatively long shackles.

Referring now to FIG. 2, the locking device, comprising the support member 38 and the pin 58 together with its integral or fixed arm 60, is shown in an assembled and locked relationship with respect to the switch actuating member 10. When it is desired to lock the switch actuating member 10 in either an "on" or "off" position, the actuating member is thrown to the preferred position and the support member 38 is then disposed over the support housing or escutcheon 14 whereby the housing projects through the opening 42. As mentioned previously, the opening 42 is preferably dimensioned such that it allows the support member 38 to be snugly fitted over the escutcheon 14 and precluding any substantial sliding movement relative thereto. Accordingly, the escutcheon 14 forms means for engagement with the support member 38 to prevent movement generally parallel to the panel surface 26 in virtually any direction. Most importantly, the end walls 18 and 20 prevent movement of the support member 38 longitudinally or in the general direction of the movement of the switch actuating member 10 when it is thrown from one position to another.

With the support member 38 in the position illustrated in FIG. 2, the pin 58 may be inserted through the opening 48, the aperture 30 and the opening 50 whereby the switch actuating member 10 is locked in the position wherein it is aligned with the openings 48 and 50 and to prevent movement of the handle to an alternate position. The arm 60 is then rotated into a position such that the openings 62 and 70 are aligned with the opening 54 in the flange 44 whereby the arm may be locked to the support member 38 by passing the shackle 82 of a padlock 84 through the openings 62, 54 and 70 and securing the lock generally in the position illustrated in FIG. 2. In this way the arm 60 cannot be rotated away from the flange 44 to a position such that the pin 58 can be removed from the openings 48 and 50 or, of course, from the opening 30 in the handle portion 28.

As will be appreciated from the foregoing description, the locking device comprising the support member 38 and the pin 58, together with its integral arm portion 60, comprises a mechanically uncomplicated two-part assembly which may be mounted on a panel surface such as the panel surface 26 without modifying a switch actuating handle as long as the handle has a suitable opening or means for registering with the pin 58. The support member 38 is advantageously adapted to permit viewing the switch actuating member 10 to permit viewing the switch position and to permit viewing any indicia printed or embossed on the escutcheon surface 16. Of course, the support member 38 may be permanently secured to the panel surface 26 by suitable fasteners, not shown, or a suitable adhesive, also not shown, so that upon unlocking the actuating member 10 for operation, only the pin 58 need be removed from its operative position shown in FIG. 2 after, of course, removal of the padlock 84. Those skilled in the art will appreciate that other means may be passed through the cooperating openings 54, 62 and 70 to secure the arm 60 in the working position of the pin 58 illustrated.

Figure 3:
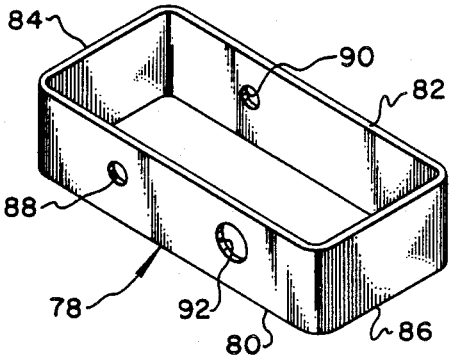
FIG. 3 is a perspective view of a first alternate embodiment of a support member for the locking device of the present invention.

Referring now to FIG. 3 there is illustrated a first alternate embodiment of a support member for the locking device and which is generally designated by the numeral 78. The support member 78 is characterized as a generally rectangular band having opposed side walls or flanges 80 and 82 and opposed end walls 84 and 86. The spacing of the side walls or flanges 80 and 82 and the spacing of the end walls 84 and 86 is such that the support member 78 may be slipped over and around escutcheon 14 in the same manner that the support member 38 is placed around the escutcheon due to the dimensional outline of the opening 42. The support member 78 has the advantage that any indicia printed on the panel surface 26 directly adjacent the escutcheon 14 is not covered by placement of the locking device it its operative position relative to the escutcheon 14. The support member 78 includes aligned openings 88 and 90 which correspond to the openings 48 and 50 in the support member 38 and a third opening 92 which corresponds to the opening 54 in the support member 38.

Figure 4:
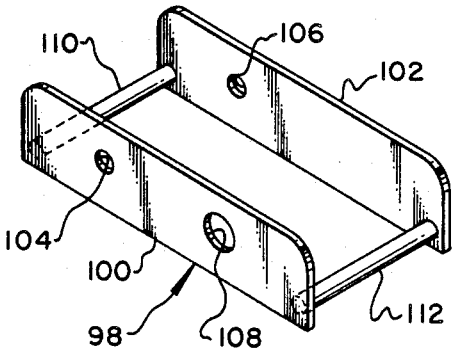
FIG. 4 is a perspective view of a second alternate embodiment of the locking device support member.

A second alternate embodiment of a support member for the locking device of the present invention is illustrated in FIG. 4 and generally designated by the numeral 98. The support member 98 includes a pair of spaced apart upstanding flanges 100 and 102 which are provided with respective aligned openings 104 and 106 for receiving the locking pin 58. A third opening 108 is provided in the flange 100 for receiving the shackle of a padlock such as the padlock 82. The support member 98 is further characterized by spaced apart generally cylindrical pin members 110 and 112 which interconnect the flanges 100 and 102. The spacing between the flanges 100 and 102 as well as the spacing between the support pins 110 and 112 is such that the support member 98 fits freely but snugly around the escutcheon 14 in registration therewith in the same manner that the other embodiments of the support member are dimensioned to fit around the escutcheon 14.

Figure 5:
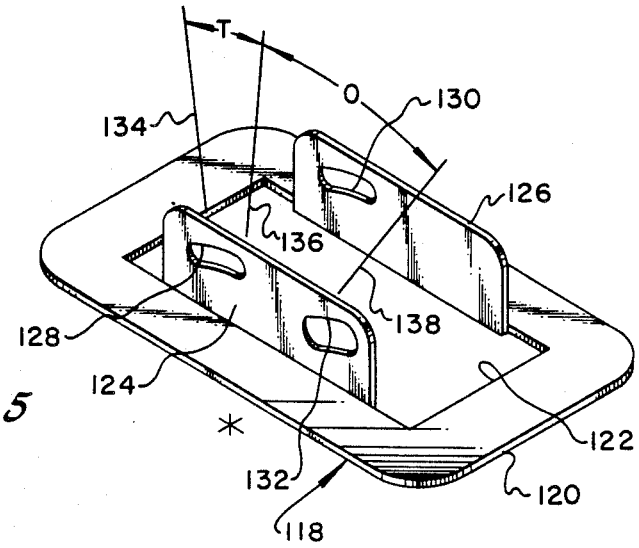
FIG. 5 is a perspective view f a third alternate embodiment of the locking device support member particularly adapted for use of the locking device with automatic circuit breaker handle members.

Referring now to FIG. 5, yet a third alternative embodiment of a support member for the locking device of the invention is illustrated and generally designated by the numeral 118. The support member 118 includes a generally planar plate portion 120 having a rectangular opening 122 formed therein. A pair of spaced apart upstanding flanges 124 and 126 are integrally formed with the plate portion 120. Spaced apart and aligned arcuate slots 128 and 130 are formed in the respective flanges 124 and 126. A second somewhat arcuate slot 128 is formed in the flange 124 and corresponds to the opening 54 formed in the corresponding flange of the support member 38.

The support member 118 is adapted to be used in conjunction with the locking pin 58 and arm assembly 60 in the same manner that the pin is used with the support member 38 and the pin is adapted to be inserted through an opening in a switch or circuit breaker handle portion similar to the handle portion 28. However, thanks to the arrangement of the arcuate slots 128, 130 and 132 a switch handle such as the handle 28 may be allowed to move through an arc "T" between an "on" position designated by the reference line 134 and a circuit breaker handle "tripped" position designated by the line 136. However, the extent of the slots 128 and 130 as well as the slot 132 is not sufficient to permit movement of the handle portion 28 to a position corresponding to the reference line 138 which corresponds to a switch handle "off" position.

In this way the support member 118, when used in conjunction with the pin 58 and its arm 60 and a padlock 84, would permit the circuit breaker handle to move from a position aligned with the reference line 134 to a position aligned with the reference line 136 to automatically "trip" but would not permit manual actuation of the circuit breaker handle to move to the "off" position corresponding to the reference line 138.

Moreover, the position of the support member 118 could be reversed and the arcuate extent of the slots 128 and 130 would be such that if the circuit breaker handle is locked in the "off" position corresponding to the reference line 138 the arc "O" and "T" would be such that the handle 28, for example could not be moved from the off position back to the "tripped" or "on" position corresponding to the reference lines 136 and 134, respectively. Accordingly, the support member 118 is adapted to permit use of the locking device in conjunction with circuit breaker handles which are preferred to be locked in the "on" position and allowed to be automatically "tripped" but not manually actuated to an "off" position.

The construction and use of the improved locking device for an electrical switch or circuit breaker handle in accordance with the description hereinabove is believed to enable those of skill in the art to practice the present invention. The members 38, 78, and the pin 58 together with the arm 60 may be made of conventional engineering materials such as heat treated steel to minimize the chance of breakage or failure due to unwanted tampering with the device when it is in its operative position.

Although a preferred embodiment of the invention has been described in detail herein, those skilled in the art will recognize that various substitutions and modifications may be made to the embodiment described and illustrated without departing from the scope and spirit of the invention as recited in the appended claims.

What we claim is:

1. A locking device for locking an electrical switch handle in a predetermined position relative to a switch panel, said switch panel including a surface forming an opening through which said switch handle projects, said switch handle being movable between working positions, said locking device comprising:

a support member including means registrable with means projecting from said surface to substantially prevent movement of said support member in a direction generally parallel to said surface, said support member including means forming a pair of spaced apart flanges adapted to be disposed on opposite sides of said switch handle, said flanges each including openings formed therein;

a locking member operable to extend into said openings in said flanges, respectively, and to be engaged with means on said switch handle to prevent movement of said switch handle relative to said flanges from one predetermined position to another; and means connected to said locking member and adapted to be secured to at least one of said flanges to secure said locking member in a position for locking said handle to prevent said movement from said one predetermined position to said another.

2. The locking device set forth in claim 1, wherein:

said openings in said flanges are configured such that said locking member can be moved relative to said support member to permit movement of said switch handle between a first position and a second position while preventing movement from said second position to a third position.

3. The locking device set forth in claim 1, wherein:

said means connected to said locking member includes an arm operable to be positioned directly adjacent said at least one flange, said arm including an opening therein operable to be aligned with a second opening in said one flange for receiving the shackle of a padlock or the like to secure said locking member in a locking position with respect to said switch handle.

4. The locking device set forth in claim 3, wherein:

said arm includes a generally channel shaped portion for receiving at least a part of said flange, said channel shaped portion including opposed openings operable to be aligned with said second opening in said one flange for receiving said shackle to prevent removal of said pin member from registration with said handle.

5. The locking device set forth in claim 1, wherein:

said means projecting from said surface includes a housing escutcheon and said support member includes an opening formed therein adapted to receive said escutcheon in such a way as to substantially prevent movement of said support member in a direction generally parallel to said surface.

6. The locking device set forth in claim 5, wherein:

said support member includes a generally planar plate portion having said opening for receiving said escutcheon formed therein, said flanges extending from said planar plate portion on opposite sides of said opening in said planar plate portion.

7. The locking device set forth in claim 5, wherein:

said support member comprises a generally rectangular band member having opposed side walls forming said flanges and joined to opposed end walls to define said opening for receiving said escutcheon.

8. The locking device set forth in claim 5, wherein:

said support member includes portions interconnecting said flanges and forming said opening for receiving said escutcheon.

9. A locking device for preventing unwanted movement of an electrical circuit breaker handle, a said handle extending from a housing portion, said locking device comprising:

a support member having an opening formed therein conforming generally to the shape of said housing portion, opposed flanges projecting from opposite sides of said opening, said flanges including opposed aligned and elongated slots formed therein;

a locking member adapted to project through said slots in said flanges and to be engaged with receiving means on said handle, said locking member being movable in said slots to permit said handle to move from an "on" position to a "tripped" position but to prevent movement of said handle from said "on" position to an "off" position beyond said "tripped" position; and means connected to said locking member and cooperable with one of said flanges for preventing removal of said locking member from said slots.

* * * * *